US005462506A

United States Patent [19]

Markland

[11] Patent Number: 5,462,506

[45] Date of Patent: Oct. 31, 1995

[54] LATERAL MOVEMENT TRAINER SELECTIVELY POSITIONABLE FOR STORAGE OR USE

[75] Inventor: Max C. Markland, Gresham, Oreg.

[73] Assignee: Joshua Group Ltd., Portland, Oreg.

[21] Appl. No.: 951,664

[22] Filed: Sep. 24, 1992

[51] Int. Cl.[6] ..... A63B 22/00

[52] U.S. Cl. ..... 482/51; 482/52; 482/54; 434/253; 242/395; 242/396.1

[58] Field of Search ..... 242/67.1 R, 85; 482/51, 54, 52; 472/90, 91; 434/253; 359/461

[56] References Cited

U.S. PATENT DOCUMENTS

| | | | |
|---|---|---|---|
| D. 321,918 | 11/1991 | Blanchard . | |
| 2,715,788 | 8/1955 | Gutshall | 242/67.1 R |
| 2,842,365 | 7/1958 | Kelley . | |
| 3,468,536 | 9/1969 | Minshull et al. . | |
| 3,497,211 | 2/1970 | Nagin . | |
| 3,508,945 | 4/1970 | Haemer et al. . | |
| 3,664,594 | 5/1972 | Novak | 242/67.1 R |
| 3,756,595 | 9/1970 | Hague . | |
| 4,060,310 | 11/1977 | Brown | 359/461 |
| 4,169,688 | 10/1979 | Toshio . | |
| 4,340,214 | 7/1982 | Schutzer . | |
| 4,438,003 | 3/1984 | Nathaniel et al. . | |
| 4,779,862 | 10/1988 | Keppler . | |
| 4,781,372 | 11/1988 | McCormack . | |
| 4,923,192 | 5/1990 | Sawdon . | |
| 4,940,226 | 7/1990 | Carra . | |
| 5,052,682 | 10/1991 | Croce, Jr. et al. . | |
| 5,076,571 | 12/1991 | Croce, Jr. et al. . | |
| 5,114,387 | 5/1992 | Keppler . | |
| 5,133,700 | 7/1992 | Braathen . | |

FOREIGN PATENT DOCUMENTS

| | | | |
|---|---|---|---|
| 2345281 | 3/1975 | Germany | 359/461 |
| 2716349 | 10/1978 | Germany | 359/461 |
| 0681892 | 2/1965 | Italy | 359/461 |
| 0602198 | 4/1978 | U.S.S.R. | 482/51 |

*Primary Examiner*—Richard J. Apley
*Assistant Examiner*—Jeanne M. Mollo
*Attorney, Agent, or Firm*—Kolisch Hartwell Dickinson McCormack & Heuser

[57] ABSTRACT

A lateral-movement trainer is disclosed which is selectively positionable for storage or use. The trainer includes an elongate slidesheet with first and second ends, and an enclosure dimensioned for substantially containing the slidesheet. Extension/retraction structure is associated with the enclosure, and is selectively actuable to move the slidesheet to either a retracted position for storage, or an extended position for use in connection with lateral-movement training. A lock mechanism is associated with the enclosure for selectively preventing undesired actuation of the extension/retraction structure. Bumper structure is coupled to the first end of the slidesheet, and the enclosure includes an outer surface with a bumper region substantially opposite the bumper structure. The enclosure is also shown being dimensioned to contain the slidesheet and bumper structure. The extension/retraction structure is also shown being constructed with a spindle rotatably mounted in the enclosure for rolling/unrolling the slidesheet. The enclosure and the bumper are also shown with plural spaced feet extending downwardly from their respective bottoms. Another embodiment shows an LMT with a block member removably couplable to the bumper structure for allowing a combined exercise of lateral-movement training and step training.

18 Claims, 5 Drawing Sheets

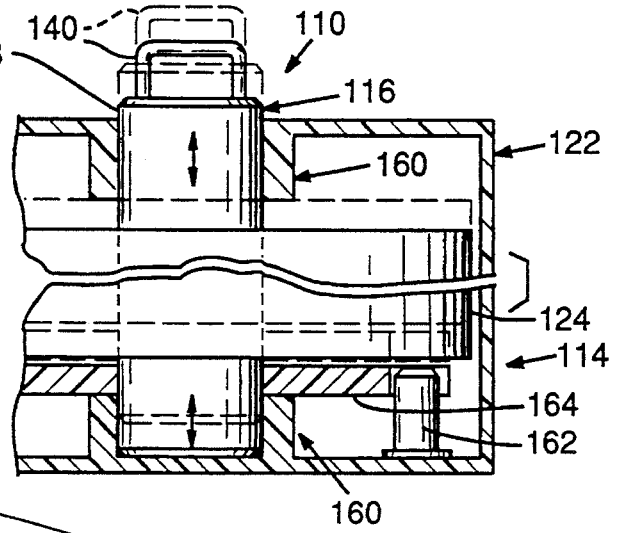
FIG. 8
FIG. 6
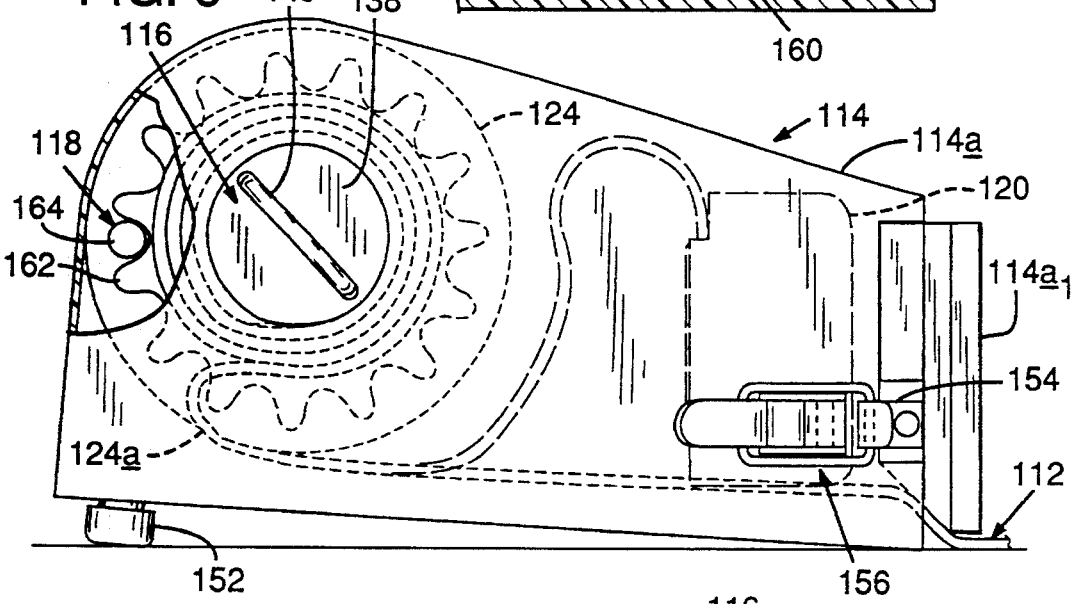
FIG. 7
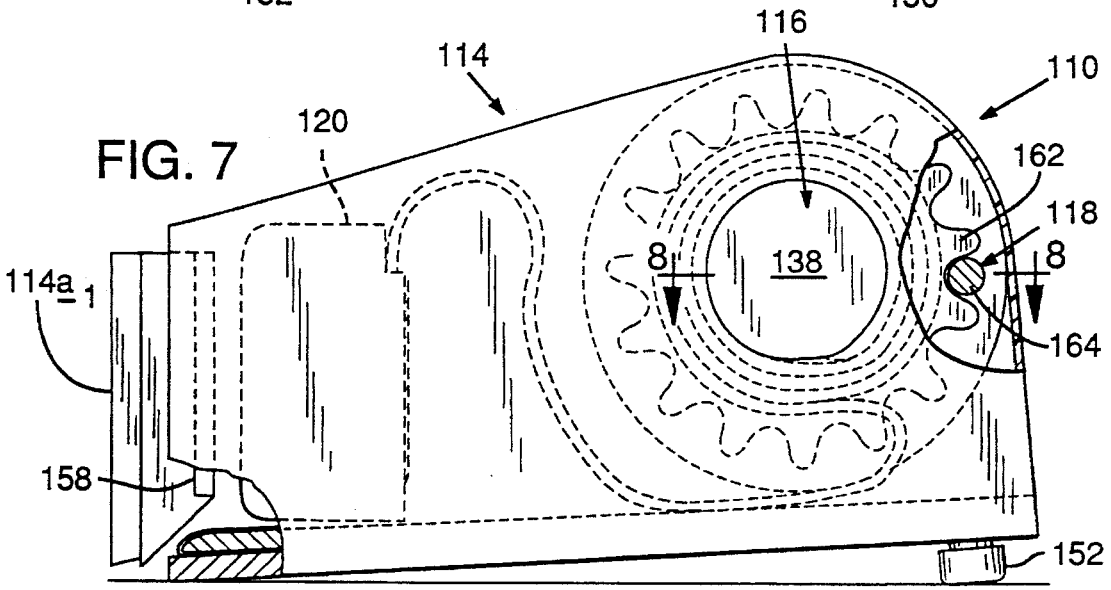

LATERAL MOVEMENT TRAINER SELECTIVELY POSITIONABLE FOR STORAGE OR USE

BACKGROUND OF THE INVENTION

The present invention relates to exercise equipment known as lateral movement trainers (LMTs), and more particularly to a lateral-movement trainer that is selectively positionable for storage or use.

A LMT allows a user to exercise certain muscles by simulating the movements of a speed skater. It is known in the exercise-equipment field to construct a LMT with a smooth elongate slidesheet, also known as a slideboard, that includes a bumper attached to each end. The user pushes off from a first bumper using a sideways leg motion, and slides to a second bumper at the opposite end of the slideboard. The user then pushes off from that other bumper and slides back to the first bumper. This back-and-forth movement is repeated to exercise the glutei and adductor muscles, as well as the quadriceps and hamstrings.

It is also known to make flexible, portable LMTs in which the LMT is constructed with a flexible slideboard that has a block-shaped bumper attached at each end. To transport them, conventional LMTs are rolled into a relatively small, tubular shape with the top surface of the slidesheet disposed inwardly. When unrolled for use, conventional LMTs tend to lie fiat along part of the length but the opposing ends tend to curl up.

There is a need for adjusting the length of the slideboard to suit the needs of the user. That is, a user who is approximately 6' tall requires a slidesheet that is approximately 8' in length whereas a user who is approximately 5' tall requires a slidesheet that is approximately 6' in length.

There is also a need to provide a system for storing LMTs both to make them easy to transport and also make them easy to store. One setting where storage becomes an issue is when LMTs are used in health clubs for aerobics classes. In such settings, a health club may store 30–40 LMTs. With conventional flexible LMTs, there is a problem because they are not enclosed in a container, and so they are susceptible to becoming damaged, such as by being crushed or otherwise damaged in storage by other, adjacent heavier athletic equipment.

Conventional LMTs also tend to slide undesirably in a bidirectional lateral motion during use when placed on depressible support surfaces such as carpeted floors. The reason for this is that their respective bottom surfaces are substantially smooth and do not adequately prevent such undesired movement. Such undesired movement is caused by the lateral forces exerted on the LMT by the user when sliding to and fro between the bumpers.

Nowhere in the prior art is there shown or suggested to construct a portable LMT that is selectively positionable for storage or use. The prior art does not show or suggest providing a portable LMT that is even partially self-contained. Further, nowhere is there shown to provide a portable LMT with a slidesheet that is adjustable in length.

Accordingly, it is a general object of the present invention to provide a LMT that overcomes the drawbacks of prior art LMTs.

Another object is to provide such a LMT that is selectively positionable for storage or use.

Yet another object is to provide such a LMT that is substantially self-contained.

A still further object is to provide such a LMT that is adjustable in length.

Another object is to provide such a portable LMT that tends not to curl up at its ends when laid flat for use.

A still further object is to provide a portable LMT that is attractive in appearance.

Yet another object of the invention is to provide a portable LMT that is durable.

Another object is to provide such a LMT that can be manufactured easily and cost-effectively.

A still further object is to provide a portable LMT that does not tend to slide undesirably in a bidirectional lateral motion during use when placed on depressible support surfaces such as carpeted floors.

SUMMARY OF THE INVENTION

In brief summary, the invention achieves the above objects by providing a lateral-movement trainer which is selectively positionable for storage or use. The trainer includes an elongate slidesheet with first and second ends, and an enclosure dimensioned for substantially containing the slidesheet. Extension/retraction structure is associated with the enclosure, and is selectively actuable to move the slidesheet to either a retracted position for storage, or an extended position for use in connection with lateral-movement training.

The trainer also includes a lock mechanism associated with the enclosure for selectively preventing undesired actuation of the extension/retraction structure. Bumper structure is also coupled to the first end of the slidesheet, and the enclosure includes an outer surface with a bumper region positioned so that it substantially opposes the bumper structure.

The enclosure is preferably dimensioned to contain the slidesheet and bumper structure. The extension/retraction structure is also preferably constructed to roll/unroll the slidesheet selectively and progressively, with the lock mechanism being constructed to prevent further rolling/unrolling after a desired amount of rolling/unrolling has been done. The extension/retraction structure is also preferably formed as a spindle rotatably mounted in the enclosure.

With respect to how the invention rests on a carpeted floors and other depressible support surfaces, the enclosure and the bumper are each preferably provided with plural spaced feet extending downwardly from their respective bottom surfaces for partially extending into the support surface. Such partial extension promotes lateral stability of the trainer during use by anchoring it in the support surface. Another embodiment includes a trainer with a block member removably couplable to the bumper structure for providing apparatus to perform a combined exercise of lateral-movement training and step training.

These and additional objects and advantages of the present invention will be more readily understood after a consideration of the drawings and the detailed description of the preferred embodiment.

BRIEF DESCRIPTION OF THE DRAWINGS

FIG. 6 is a fragmentary, right-side elevational view of the preferred embodiment of the present invention with a section broken away to show detail.

FIG. 7 is a left-side elevational view of the embodiment shown in FIG. 6 with certain portions broken away to show detail.

FIG. 8 is a top sectional view through line 8—8 of FIG. 7.

DETAILED DESCRIPTION OF THE INVENTION

Figure 10:
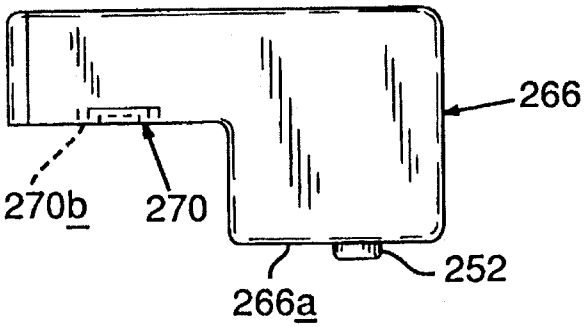
FIG. 10 is a left-side elevational view of part of the embodiment illustrated in FIG. 9.
Figure 9:
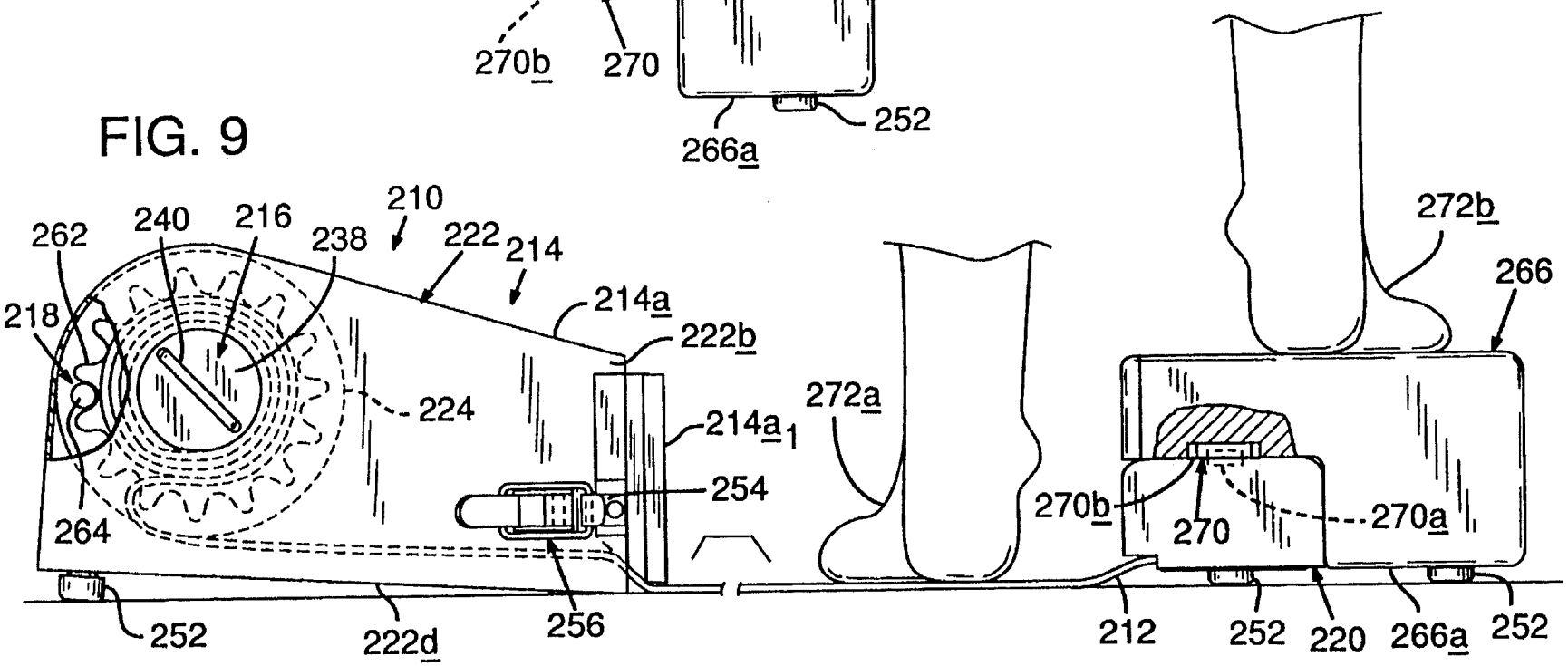
FIG. 9 is a right-side, fragmentary elevational view of another embodiment showing the invention in an extended position for use, with a section broken away to show detail, and with the feet of the user depicted to illustrate a combination step-and-slide exercise performable on it.

Referring generally to the drawings, FIGS. 1–5 show one embodiment of the present invention, FIGS. 6–8 show the preferred embodiment, and FIGS. 9–10 show another embodiment. Also, referring generally to the drawings, it should be understood that the usual convention has been followed with respect to reference numerals for multiple embodiments of the invention. That is, reference numerals under 100 correspond to the first embodiment, reference numerals in the 100-series correspond to the second (preferred) embodiment, and reference numerals in the 200-series correspond to the third embodiment. Prior to discussing the preferred embodiment, the embodiment illustrated in FIGS. 1–5 will be discussed, which embodiment includes many features common to the preferred embodiment. Also, as a way of providing an overview of certain details on lateral-movement trainers (LMTs), reference is made generally to the description in my co-pending U.S. patent application, Ser. No. 07/925,988, filed Aug. 6, 1992, which description is incorporated herein by reference.

FIRST EMBODIMENT

Figure 1:
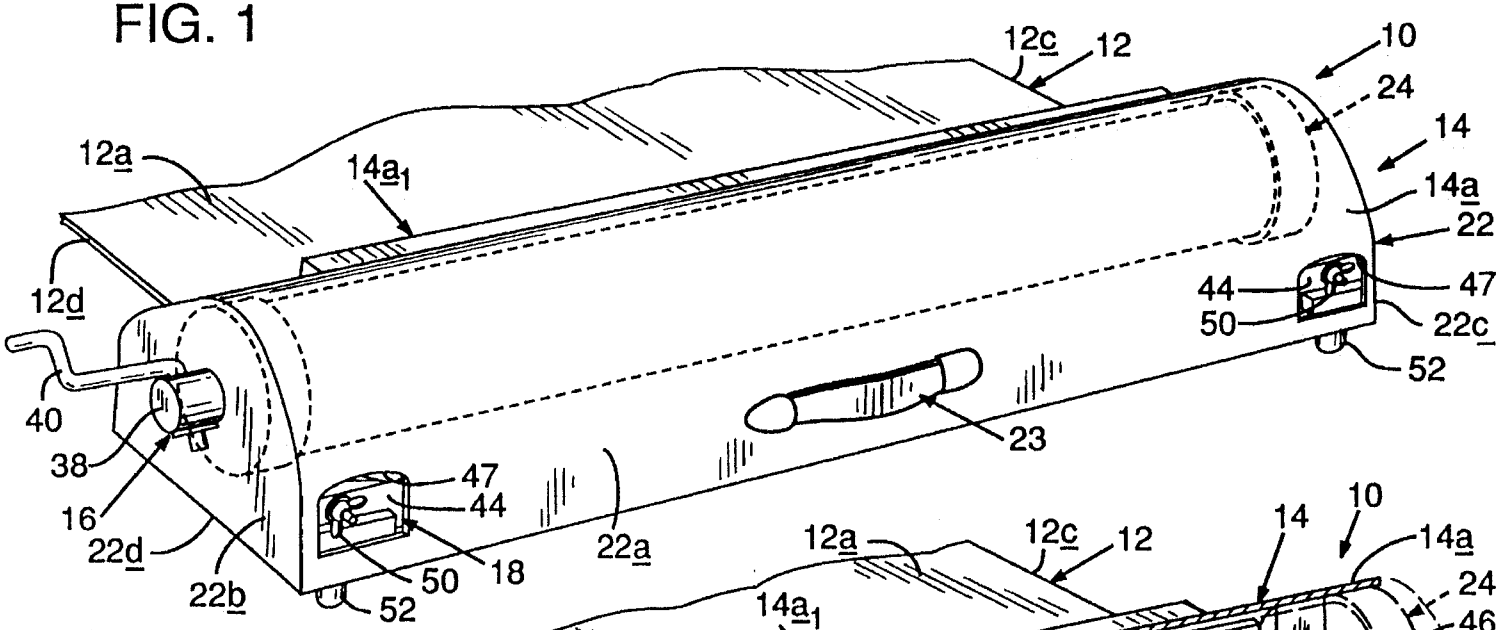
FIG. 1 is a fragmentary isometric view of one embodiment of the present invention.
Figure 2:
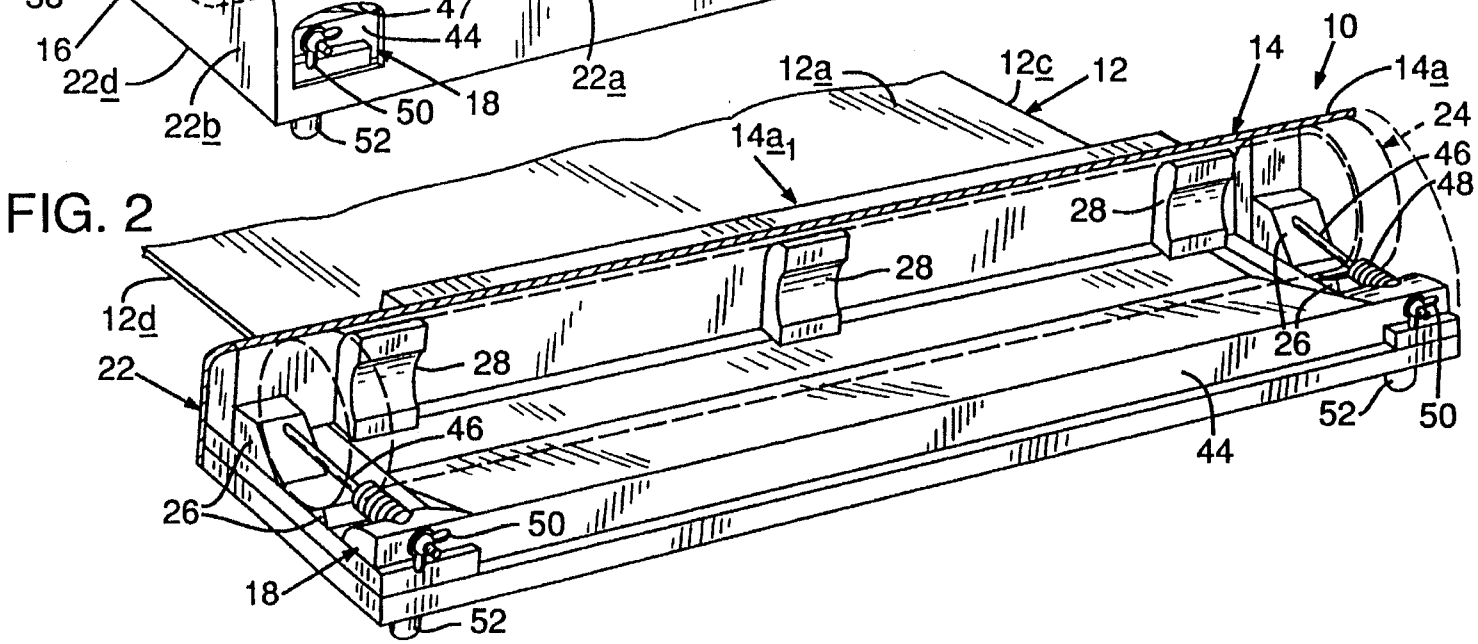
FIG. 2 is like FIG. 1 but with certain sections broken away to show detail.
Figure 2A:
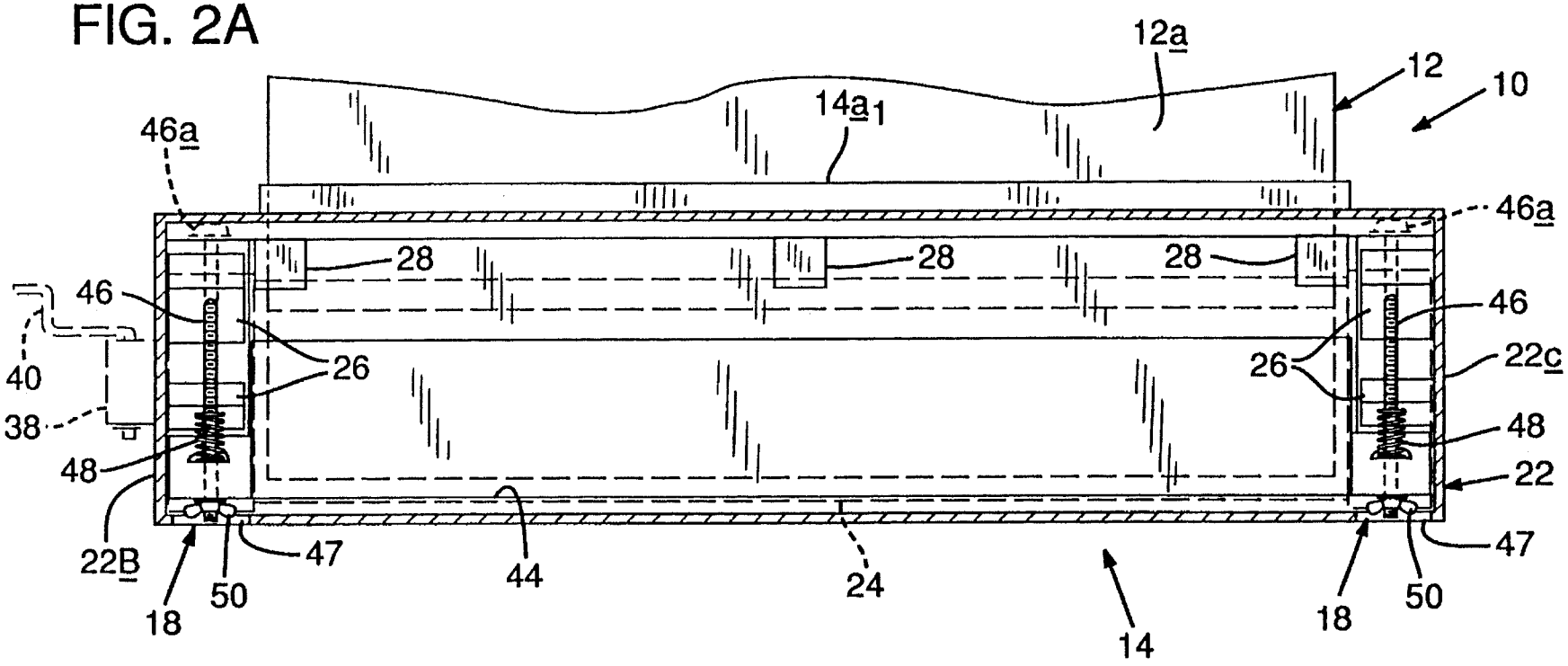
FIG. 2A is top, sectional view of FIG. 1.
Figure 3:
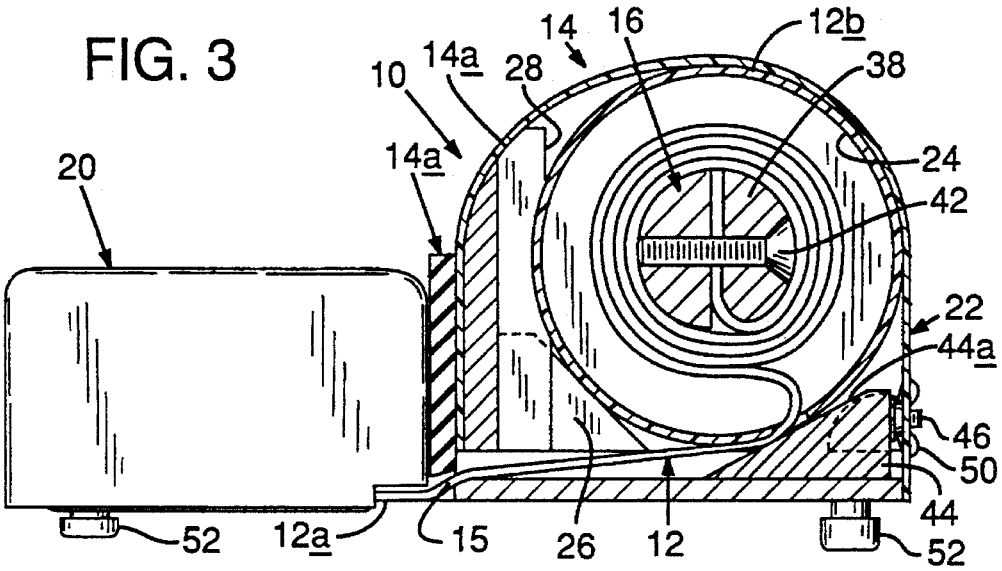
FIG. 3 is a right-side sectional view of the embodiment shown in FIGS. 1A–2A, with certain portions shown in sectional view, and showing the invention in a retracted position for storage.

Referring to FIGS. 1–2A, a LMT made in accordance with the present invention is shown at 10. LMT 10 includes an elongate slidesheet 12 and an enclosure 14 dimensioned for substantially containing the slidesheet, which containment is best shown in FIG. 3. Maintaining focus on FIG. 3, slidesheet 12 includes first and second ends 12*a*, 12*b*, respectively, and top and bottom surfaces 12*c*, 12*d*, respectively. The slidesheet is extendable out of enclosure 14 via a lateral slot 15 formed therein.

Referring again to FIGS. 1–2A, extension/retraction structure 16 is associated with enclosure 14. As will be described, extension/retraction structure 16 is selectively actuable to move the slidesheet to either a retracted position for storage, or an extended position for use in connection with lateral-movement training. Referring to FIGS. 1–5, LMT 10 also includes a lock mechanism 18 associated with enclosure 14 for selectively preventing undesired actuation of extension/retraction structure 16 as will also be described.

Referring to FIG. 3, first end 12*a* of slidesheet 12 is coupled to bumper structure 20. It should be understood that coupling of first end 12*a* to bumper structure 20 can be accomplished in any suitable way, and the preferred way is to do so according to the attachment assembly shown in my above-identified co-pending U.S. patent application. Also, the construction of bumper structure 20 and slidesheet 12 is further detailed in my above-identified, copending U.S. patent application.

Figure 4:
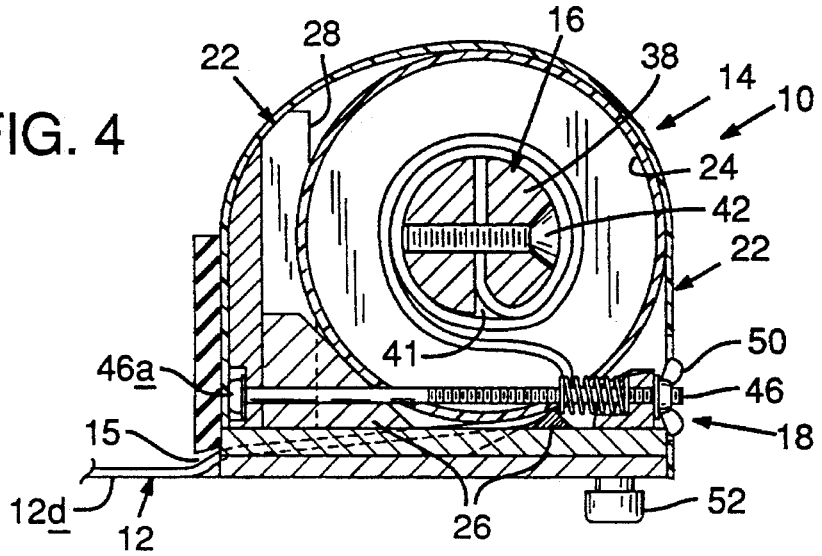
FIG. 4 is a fragmentary view like FIG. 3 except that an inner section is illustrated, and the invention has been moved to an extended position for use.
Figure 5:
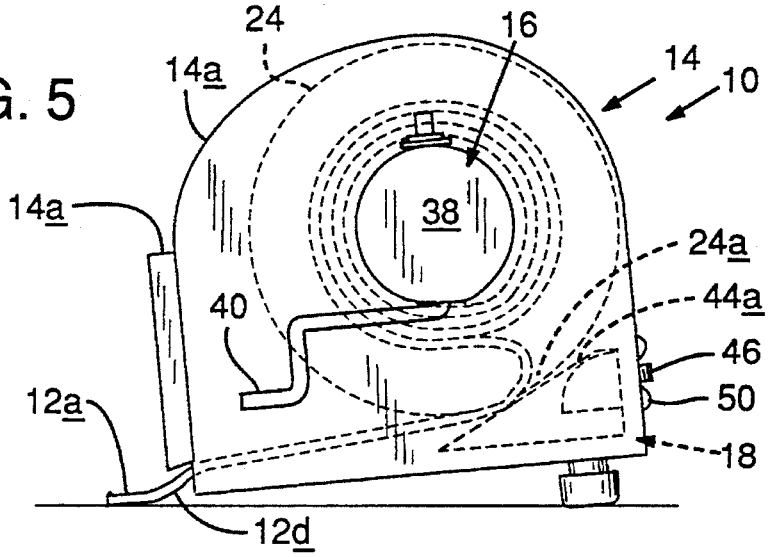
FIG. 5 is a fragmentary left-side elevational view of the embodiment shown in FIGS. 1–4.

Referring to FIGS. 3–4, an outer surface 14*a* of enclosure 14 includes a bumper region $14a_1$ positioned so that it substantially opposes bumper structure 20. This orientation between the bumper structure and bumper region is to allow a user to perform lateral-movement training when the slidesheet is in a to-be-described extended position with bumper structure 20 and bumper region $14a_1$ spaced apart (FIG. 3 shows a retracted position). As will be explained, the extended position results in bumper structure 20 being positioned well to the left of that location depicted in FIG. 3 so that a desired length of slidesheet 12 extends out of enclosure 14.

Referring to FIGS. 1–3, further details of enclosure 14, extension/retraction structure 16 and lock mechanism 18 will now be described. With respect to enclosure 14, it includes an enclosure body 22 which has a top 22*a*, sides 22*b–c*, and a bottom 22*d*. The enclosure may be made of any suitable material, and as shown in FIGS. 1–5, top 22*a* and sides 22*h–c* are made from plastic while bottom 22*d* is made from wood. Attached to the outside of the body is a grip 23 (FIG. 1) to aid in carrying LMT 10. Housed within body 22 is a covered tube 24 which preferably has an inside diameter of about 6". Tube 24 is mounted on horizontal brackets 26, and against vertical brackets 28. All brackets are suitably fastened to the enclosure body.

Referring to FIGS. 1 and 2A–5, extension/retraction structure 16 includes a spindle 38 rotatably mounted on enclosure 14 by being positioned through corresponding holes formed in opposing ends of tube 24, and formed in sides 22*h–c*, such as the holes formed in side 22*b* and the tube end nearest it in FIG. 1. Spindle 38 preferably has an outside diameter of about 2½", and also has a suitably attached handle 40 to accommodate actuation, i.e. rotation about its long axis. Referring to FIGS. 3–4, spindle is also formed with a longitudinal slot 41 for receiving second end 12*b*, which end is fixed in position with suitable fasteners driven transversely through the spindle such as fastener 42. Slidesheet 12 is rolled on the spindle with bottom surface 12*d* inwardly disposed relative to the extension/retraction structure. This orientation tends to prevent the slidesheet from rolling up adjacent the first end when in the extended position.

With respect to lock mechanism 18, FIGS. 1–2A show that it includes a pushplate 44 which is slidably movable laterally and bidirectionally along the long axis of bolts 46, each of which are fixedly positioned through brackets 26 and pushplate 44. Referring to FIG. 1, the user has access to pushplate 44 via recesses 47 formed in enclosure body 22. Referring to FIGS. 2–2A, the bolts are each fitted with a spring 48 and a wing nut 50 which nut is threadable at one end to tighten pushplate 44 in a to-be-described, locking position. Each bolt head, such as bolt head 46*a* (FIG. 4) is positioned in a recess formed in a front section of enclosure body 22. The locking position of lock mechanism 18 is achieved by selectively moving pushplate 44 forwardly so that its downwardly angled surface 44*a* is positioned against tube 24 adjacent a longitudinal opening 24*a* formed in it. Opening 24*a* allows the slidesheet to exit the tube, and the effect of moving surface 44*a* against the slidesheet at that point is to fix the position of the slidesheet by preventing an additional amount of it from exiting tube 24.

Completing the description of the embodiment shown in FIGS. 1–5, bottom surfaces of bumper structure 20 and enclosure body 22 include plural spaced feet 52 which are fastened thereto using suitable fasteners such as screws. The significance of the feet will be described.

SECOND PREFERRED EMBODIMENT

Referring now to FIGS. 6–8, a LMT made in accordance with the preferred embodiment of the present invention is shown at 110. Only details that differ from the first embodiment will be described. There are two key features of the preferred embodiment that differ from the above-described one.

First, enclosure 114 is dimensioned to contain slidesheet 112 and bumper structure 120, the latter being shown in FIGS. 6–7 with dashed lines and in a retracted position for storage. In connection with this dimensioning, bumper region 114$a_1$ is detachably removable from the enclosure to open it and allow the slidesheet and bumper structure to be removably placed therein. Referring to FIG. 6, bumper region 114$a_1$ is detachably removable from the enclosure by being fitted on its left side with a suitable fastener such as a hook member 154 which accommodates fastening the enclosure by engaging a toggle 156 attached to an adjacent section of the enclosure. Referring to FIG. 7, the left side of bumper region 114$a_1$ includes a tab 158 which is received in a corresponding slot formed in an inside surface of enclosure 114 at a location adjacent tab 158. The idea is to place tab 158 in the slot and then attach the bumper region to the enclosure via the hook member and toggle.

Second, extension/retraction structure 116 and lock mechanism 118 are different from that described in the first embodiment. Referring to FIG. 8, spindle 138 is rotatably mounted on enclosure 114 by being frictionally received in bearings 160. Spindle 138 may be suitably sized relative to the bearings to allow an optimum amount of fit, i.e. so that the spindle will not tend to slide out of the enclosure but will still be rotatable. Of course other designs are possible to ensure that the spindle remains in the enclosure such as by providing a stop member (undepicted) that prevents undesired lateral movement of the spindle.

Referring to FIGS. 6–8, lock mechanism 118 includes a sprocket 162 circumferentially coupled to one end of spindle 138, that is selectively engageable with a post 164 extending inwardly from an inside surface of enclosure 114. Referring to FIG. 8, selective engagement is achieved by pushing the spindle into the enclosure from the side with handle 140, as shown in solid lines. In such position, adjacent teeth of sprocket 162 engage post 164 (FIGS. 6–8). Disengagement to an unlocked, rotatable position is achieved by pulling handle in the opposite direction so that spindle 138 is in the position shown by dashed lines in FIG. 8. It should also be appreciated that reattachment of bumper region 114$a_1$ to enclosure 114 will provide a secondary lock mechanism by sandwiching the slidesheet between it and bottom 122*d* of enclosure body 122.

THIRD EMBODIMENT

Referring now to FIGS. 9–10, a LMT made in accordance with a third embodiment of the present invention is shown at 210. Again, only details that differ from other embodiments will be described. There is one key feature of the third embodiment that differs from the above-described ones. Referring to FIG. 9, a block member 266 is removably couplable to bumper structure 220, thereby to provide a trainer that is usable for performing a to-be-described, combined exercise of lateral-movement training and step training. Block member 266 is larger than bumper structure 220 and includes a bottom region 266*a* with a notch formed in it as shown at 268 in FIG. 10. Referring back to FIG. 9, the notch defines a space corresponding in size to bumper structure 220, and the bumper structure is constructed for coupling to bottom region 266*a* in the notch, as by having a suitable fastener such as shown schematically at 270 in FIG. 9. For example, the fastener may take the form of a snap member 270*a* formed in the top of bumper structure 220, and a suitable snap-receiving member 270*b* formed in bottom region 266*a*.

OPERATION

LMT 10 is selectively positionable from the retracted, storage position shown in FIG. 3 to an extended, use position shown in FIG. 10 by releasing the lock mechanism and pulling the bumper structure away from the enclosure. With respect to the first embodiment, and with reference to FIGS. 1–5, this involves turning wing nuts 50 counterclockwise to release spring-biased pushplate 44 so that it will move rearward (see FIG. 3) from its locked position in the direction of the arrow. Then bumper structure 20 can be pulled away from enclosure 14 with slidesheet 12 unrolling from spindle 38 to a desired extended position. The extended position is locked by again moving pushplate 44 forwardly against slidesheet 12 where it exits tube 24 at opening 24*a* (see FIG. 3).

With respect to the second, preferred embodiment and the third embodiment, and with reference to FIGS. 6–9, selective positioning from a retracted, storage position to an extended, use position is accomplished by first (see FIGS. 6–7) removing bumper region 114$a_1$ from enclosure 114 by releasing toggle 156, pivoting the bumper region by moving the toggle side of it away from enclosure 114, and removing tab 158 from the slot in the enclosure by pulling the bumper region away from the slot. Then, referring to FIG. 8, spindle 138 is moved laterally to the position shown with dashed lines by pulling handle 140. Sprocket 162 is thus disengaged from post 164 and spindle 138 is freely rotatable on its long axis to allow unrolling of slidesheet 112 so that it can be moved to an extended position such as that shown in FIG. 9. While the reference numerals above correspond to the preferred embodiment, it should be understood that the same operations are used in connection with third embodiment 210.

Referring to the third embodiment, once slidesheet 212 is moved to the extended position shown in FIG. 10, the user can perform the above-noted combination step-and-slide exercise by moving on and off of block member 266 at desired times during lateral-movement training. For example, the user can move his or her feet, shown at 272*a–b*, up onto block member 266 and then back down to slidesheet 212 to continue lateral-movement training. It should be understood that all kinds of variations are possible with LMT 210 wherein the user can combine such step training with such lateral-movement training.

The reader will appreciate that LMTs 10, 110 and 210 achieve the above objects by overcoming the drawbacks of prior art LMTs. Each LMT is selectively positionable for storage or use, and each LMT is substantially self-contained.

When moved to an extended position, the slidesheet of each invented LMT tends not to curl up at its ends because each slidesheet is rolled up with its bottom surface inwardly disposed relative to the extension/retraction structure.

Also, LMTs 10, 110, and 210 are each attractive in appearance and durable, and can be manufactured easily and cost-effectively. Finally, because each LMT is provided with feet such as feet 52, 152, 252, they tend not to slide undesirably in a bidirectional lateral motion during use when placed on depressible support surfaces such as carpeted floors. That is, as the user performs lateral-movement training on each LMT, the feet of the LMT tend to work into the carpet and anchor the LMT in position. Such anchoring counteracts the lateral forces exerted on the LMT by the user when sliding to and fro between the bumpers.

While the present invention has been shown and described with reference to the foregoing preferred embodiment, it will be apparent to those skilled in the art that other changes in form and detail may be made therein without departing from the spirit and scope of the invention as defined in the appended claims.

I claim:

1. A lateral-movement trainer that is selectively positionable for storage or use, comprising:

bumper structure:

an elongate slidesheet with first and second ends, the slidesheet being formed from a flexible material capable of supporting the weight of a user, and being sized to accomodate lateral-movement training thereon, and wherein the first end of the slidesheet is coupled to the bumper structure;

an enclosure dimensioned for substantially containing the slidesheet, the enclosure including an outer surface with a bumper region positioned so that it substantially opposes the bumper structure when in the extended position, thereby allowing a user to perform lateral-movement training when the slidesheet is in the extended position by sliding laterally on it in opposite directions between the bumper structure and bumper region; and extension/retraction structure connected to the enclosure, and being selectively actuable to move the slidesheet to either a retracted position for storage, or an extended position for use in connection with lateral-movement training.

2. The trainer of claim 1, further including a lock mechanism connected to the enclosure for selectively preventing undesired actuation of the extension/retraction structure.

3. The trainer of claim 2 wherein the enclosure and the bumper each include a bottom that is contactable with a depressible support surface, and wherein each respective bottom includes plural spaced feet extending downwardly therefrom for partially extending into the support surface, to promote lateral stability of the trainer with respect to the support surface during use.

4. The trainer of claim 2, further including a block member removably couplable to the bumper structure for performing a combined exercise of lateral-movement training and step training, with the step training involving movement by the user on and off of the block member.

5. The trainer of claim 4 wherein the block member is larger than the bumper structure and includes a bottom region with a notch formed in it, with the notch defining a space corresponding in size to the bumper structure, and wherein the bumper structure is constructed for coupling to the underside of the block member in the notch.

6. The trainer of claim 1 wherein the enclosure is also dimensioned to contain the bumper structure, and wherein the bumper region is detachably removable from the enclosure to open it and allow the slidesheet and bumper structure to be removably placed therein.

7. The trainer of claim 1 or 6, wherein the extension/retraction structure is constructed with a roller mechanism to roll/unroll the slidesheet selectively and progressively, and the lock mechanism is constructed with a stop mechanism that is selectively actuable to engage the roller mechanism to prevent further rolling/unrolling after a desired amount of rolling/unrolling has been done.

8. The trainer of claim 7, wherein the roller mechanism includes a spindle rotatably mounted on the enclosure for rolling/unrolling the slidesheet, with the spindle having a handle to accommodate actuating it, wherein the enclosure includes an inside surface, and wherein the lock mechanism includes a sprocket circumferentially coupled to one end of the spindle, and selectively engageable with a post extending from the inside surface of the enclosure, to prevent undesired rolling/unrolling.

9. The trainer of claim 1 further including a block member removably couplable to the bumper structure, thereby to provide a trainer that is usable for performing a combined exercise of lateral-movement training and step training, with the step training involving movement by the user on and off of the block member.

10. The trainer of claim 9 wherein the block member is larger than the bumper structure and includes a bottom region with a notch formed in it, with the notch defining a space corresponding in size to the bumper structure, and wherein the bumper structure is constructed for coupling to the underside of the block member in the notch.

11. A lateral-movement trainer that is selectively positionable for storage or use, comprising:

an elongate slidesheet with first and second ends;

an enclosure dimensioned for substantially containing the slidesheet;

extension/retraction structure connected to the enclosure, and being selectively actuable to move the slidesheet to either a retracted position for storage, or an extended position for use in connection with lateral-movement training;

wherein the first end of the slidesheet is coupled to bumper structure;

wherein the enclosure includes an outer surface with a bumper region positioned so that it substantially opposes the bumper structure when in the slidesheet is in the extended position, thereby allowing a user to perform lateral-movement training when the slidesheet is in the extended position by sliding laterally on it in opposite directions between the bumper structure and bumper region; and wherein the enclosure is also dimensioned to contain the bumper structure, and wherein the bumper region is detachably removable from the enclosure to open it and allow the slidesheet and bumper structure to be removably placed therein.

12. The trainer of claim 11 further including a lock mechanism connected to the enclosure for selectively preventing undesired actuation of the extension/retraction structure.

13. The trainer of claim 12, wherein the extension/retraction structure is constructed with a roller mechanism to roll/unroll the slidesheet selectively and progressively, and the lock mechanism is constructed with a stop mechanism that is selectively actuable to engage the roller mechanism to prevent further rolling/unrolling after a desired amount of rolling/unrolling has been done.

14. The trainer of claim 13, wherein the roller mechanism includes a spindle rotatably mounted on the enclosure for rolling/unrolling the slidesheet, with the spindle having a handle to accommodate actuating it, wherein the enclosure includes an inside surface, and wherein the lock mechanism includes a sprocket circumferentially coupled to one end of the spindle, and selectively engageable with a post extending from the inside surface of the enclosure, to prevent undesired rolling/unrolling.

15. The trainer of claim 13, wherein the enclosure and the bumper structure each include a bottom that is contactable with a depressible support surface, and wherein each respective bottom includes plural spaced feet extending downwardly therefrom for partially extending into the support surface, to promote lateral stability of the trainer with respect to the support surface during use.

16. The trainer of claim 14, wherein the enclosure and the bumper structure each include a bottom that is contactable with a depressible support surface, and wherein each respective bottom includes plural spaced feet extending downwardly therefrom for partially extending into the support surface, to promote lateral stability of the trainer with respect to the support surface during use.

17. The trainer of claim 11, 12, 13, 14 or 15, further including a block member removably couplable to the bumper structure for performing a combined exercise of lateral-movement training and step training, with the step training involving movement by the user on and off of the block member.

18. The trainer of claim 17 wherein the block member is larger than the bumper structure and includes a bottom region with a notch formed in it, with the notch defining a space corresponding in size to the bumper structure, and wherein the bumper structure is constructed for coupling to the underside of the block member in the notch.

* * * * *